US007470055B2

(12) United States Patent
Hacker et al.

(10) Patent No.: US 7,470,055 B2
(45) Date of Patent: Dec. 30, 2008

(54) MOUNTING STRUCTURE FOR LED LIGHTING SYSTEMS

(75) Inventors: Christian Hacker, Treviso (IT); Alessandro Maschietto, Paese (IT); Giovani Scilla, Fontane di Villorba (IT); Alessandro Scordino, Mestre (IT)

(73) Assignee: Patent-Treuhand-Gesellschaft fur Elektrische Gluhlampen mbH, Munich (DE)

( * ) Notice: Subject to any disclaimer, the term of this patent is extended or adjusted under 35 U.S.C. 154(b) by 117 days.

(21) Appl. No.: 11/510,741

(22) Filed: Aug. 28, 2006

(65) Prior Publication Data

US 2007/0047243 A1 Mar. 1, 2007

(30) Foreign Application Priority Data

Aug. 29, 2005 (EP) ..... 05425602

(51) Int. Cl.
*H01R 33/00* (2006.01)
*F21S 4/00* (2006.01)

(52) U.S. Cl. ..... 362/640; 362/225; 362/646; 362/652; 362/659

(58) Field of Classification Search ..... 362/238, 362/240, 223, 225, 800, 640, 646, 652, 659, 362/657, 222, 249, 547, 218, 264, 294
See application file for complete search history.

(56) References Cited

U.S. PATENT DOCUMENTS 5,107,408 A * 4/1992 Vernondier ..... 362/238
6,183,104 B1 2/2001 Ferrara
6,472,823 B2 * 10/2002 Yen ..... 315/112
6,659,623 B2 * 12/2003 Friend ..... 362/249
6,882,111 B2 4/2005 Kan et al.
6,924,744 B2 * 8/2005 Bohlander et al. ..... 340/815.45
7,063,440 B2 * 6/2006 Mohacsi et al. ..... 362/240
7,101,056 B2 * 9/2006 Pare ..... 362/190
2002/0149933 A1 10/2002 Archer et al.

(Continued)

FOREIGN PATENT DOCUMENTS

DE 199 14 281 C1 3/2000

(Continued)

OTHER PUBLICATIONS

European Application No. EP 05 42 5602, European Search Report dated Feb. 21, 2006, 5 pgs.

*Primary Examiner*—Jacob Y Choi
(74) *Attorney, Agent, or Firm*—Carlo S. Bessone; Kenneth D. LaBudda

(57) ABSTRACT

A mounting structure for LED lighting sources, includes a support body having attached on one side thereof a circuit board for mounting the LED lighting sources. The circuit board is preferably a printed-circuit board with conductive traces to feed electrical power to the LED lighting sources. The support body is in the form of an elongated bar or a box with a linear, round, square, hexagonal or octagonal shape. The support body is a drawn or molded body of a lightweight material and preferably exhibits good heat transfer properties. The support body includes a back side for mounting the structure on a supporting surface, such back side possibly having associated a heat dissipation fixture. Additionally, the support body may have free space inside and/or be at least partially apertured to permit cooling air flow for a driver circuit for driving the LED lighting source.

23 Claims, 3 Drawing Sheets

U.S. PATENT DOCUMENTS

2003/0174517 A1 9/2003 Kiraly et al.
2005/0265019 A1* 12/2005 Sommers et al. ..... 362/217

FOREIGN PATENT DOCUMENTS

DE 201 01 675 U1 9/2001
DE 102 42 292 A1 4/2004
EP 1 182 396 A1 2/2002
WO 03/102467 A2 12/2003
WO 2005/024291 A2 3/2005

* cited by examiner

MOUNTING STRUCTURE FOR LED LIGHTING SYSTEMS

FIELD OF THE INVENTION

The present invention relates to lighting systems including light emitting diodes (LEDs) as light sources.

DESCRIPTION OF THE RELATED ART

In addition to their established use as display elements, light emitting diodes (LEDs) are becoming increasingly popular as lighting sources. This applies primarily to so-called high-flux or high-brightness LEDs.

An LED lighting system typically includes a number of components such as one or more LED light sources, a driver circuit, a heat sink, optics, connection means, ancillary mounting elements. These components require interconnections that may easily turn out to be rather complex. In view of this, present day LED lighting systems exhibit only limited possibilities of integration. For example, the driving circuits are usually implemented as a part of the power supply module.

OBJECT AND SUMMARY OF THE INVENTION

In view of the foregoing, the need is felt for improved mounting structures for LED lighting systems that i.a. i) may permit an extensive integration of the components of an LED lighting system, ii) result in lighting systems of compact size, iii) facilitate handling, connecting and mounting of the system, and iv) facilitate maintenance and replacement of any single component.

The object of the invention is to provide a fully satisfactory response to that need.

According to the present invention, this object is achieved by means of a structure having the features set forth in the claims that follow. The claims are an integral part of the disclosure of the invention provided herein.

A preferred embodiment of the arrangement described herein is thus a mounting structure for an LED lighting system including at least one LED lighting source, the structure including (e.g. by having attached thereon) a circuit board for mounting said at least one LED lighting source, said circuit board having conductive traces to feed electrical power to said at least one LED lighting source.

BRIEF DESCRIPTION OF THE ANNEXED DRAWINGS

The invention will now be described, by way of example only, with reference to the enclosed figures of drawing, wherein.

DETAILED DESCRIPTION OF PREFERRED EMBODIMENTS OF THE INVENTION

Figure 1:
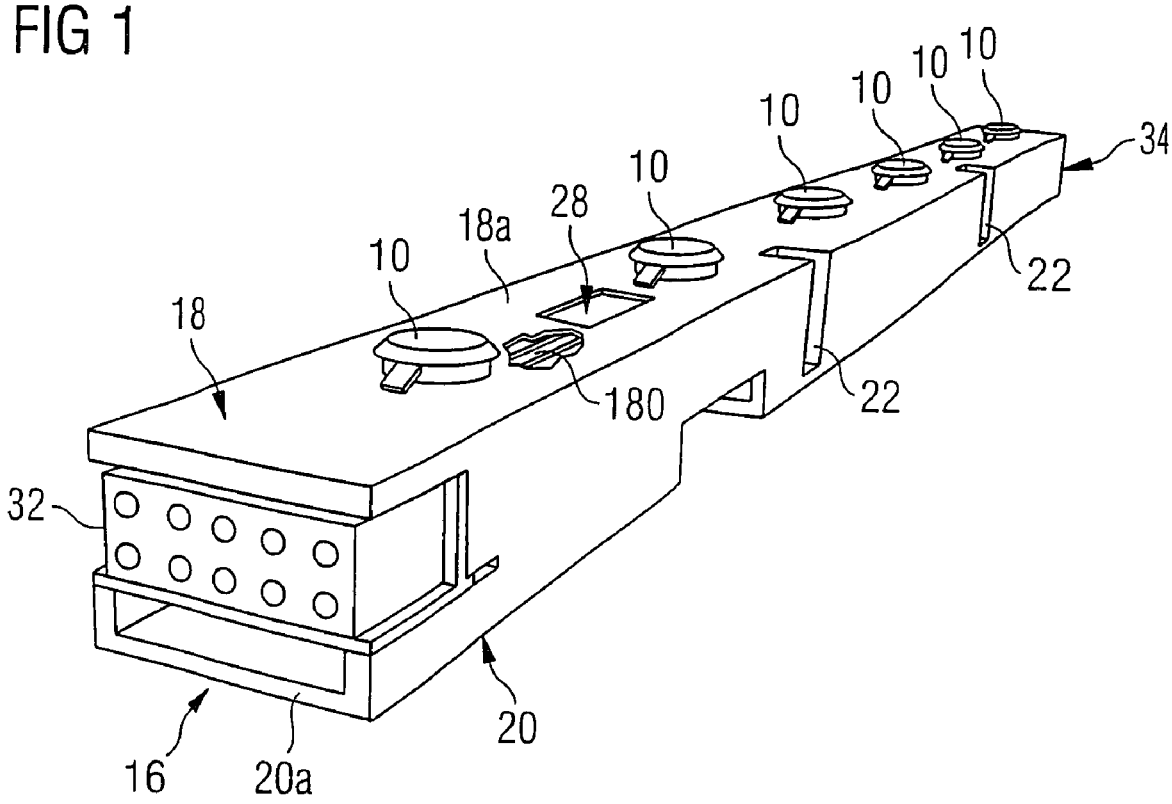
FIG. 1 is schematic perspective representation of a first embodiment of a LED mounting structure as described herein.

FIG. 1 is generally representative of a mounting structure for an LED lighting system including one or more LED lighting sources 10.

As illustrated herein, each of the light sources 10 includes an LED element that may be in association with a disc-like optical system to create a sort of button-like assembly. Nevertheless, any other (possibly bigger) optical system may used within the framework of the arrangement described herein, the same also applying to light sources with a fixed optical system or without any optical system at all. Such an assembly is known in the art and resorting to such an assembly is not a mandatory requirement of the invention: in fact the invention as disclosed herein is applicable to LED lighting sources having different shapes and/or included in different type of assemblies, including assemblies that do not comprise an associated optical system.

All the light sources 10 are attached to a circuit board 18*a* with conductive traces 180 to feed electrical power to the light sources 10. The circuit board 18*a* (typically a printed-circuit board or PCB) is preferably attached to the front side 18 of the support body 16. Typically, the printed circuit board 18*a* has the conductive traces 180 printed thereon and the light sources 10 include protruding contacts for contacting the conductive traces 180.

The circuit board 18*a* (better depicted in FIG. 5) may be of any suitable material (e.g. FR4, CEM, PI) to ensure electrical connection to the light sources 10 via the traces 180 and electrical isolation to the body 16. A preferable material also offers a good heat transfer to the body 16. Therefore glued or screwed circuit boards 18*a* are preferred to ensure a good thermal connection to the body 16. Production of the circuit board 18 is in accordance with state of the art technologies. The upper surface is preferably protected from direct exposure to the outside by a coating or covering such as e.g. a paint layer, a plastics foil or the like.

Figure 2:
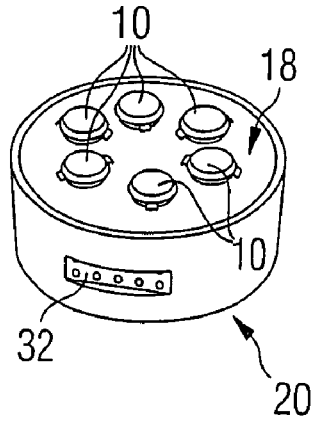
FIG. 2 is illustrative of a different geometric configuration of the structure described herein.

In the embodiment illustrated in FIG. 1, the support body 16 is in the form of an elongated, box-like, generally hollow bar having a rectangular cross section. In the alternative embodiment illustrated in FIG. 2 the support body 16 is in the form of a substantially round box. The shapes illustrated in FIGS. 1 and 2 are purely illustrative: the support body 16 may in fact be of any shape, e.g. linear, round, square, hexagonal, octagonal, and so on.

By way of example, the bar-like support body 16 illustrated in FIG. 1 may be of a parallelepiped shape overall with dimensions of e.g. 15×20×300 mm (for height, width and length, respectively).

Whatever its form, the support body 16 typically includes two opposed flat sides 18 and 20, generally parallel to each other.

The body 16 may include partially open sides to permit additional airflow for cooling purposes.

As seen in the drawing, the first side 18 is in an upper or "top" position, while the opposite side 20 forms a lower or "bottom" side of the support body 16.

In a typical mounting arrangement, the body 16 is placed inside a lighting fixture and/or attached to this fixture via the bottom side 20. For an easy handling it is preferable that the body 16 includes recessed passages 22 for mounting screws or similar retain elements.

The material comprising the support body 16 may be any material suitable for producing a body of sufficient mechanical strength. Lightweight materials such as a metal (e.g. aluminum), plastics adapted to be shaped by standard techniques (e.g. drawing, molding) are suitable for use within the framework of the invention. Materials exhibiting have a good heat transfer coefficient (e.g.: aluminum, metal-loaded plastics) represent preferred choices.

The "back" side 20 of the body 16 (opposite to the LED sources 10) may be attached to another structure 20*a* (e.g.: a finned fixture) to allow additional heat dissipation. In this case the other structure is working as an additional heat sink.

In order to make the structure compact, the overall dimensions of the support body 16 are preferably selected to be just enough to allow mounting on the front side 18 a PCB element 18*a* adapted to carry the LED sources 10 with their electrical connections, while permitting the insertion of a driver 24 having an associated driver board 24*a* (e.g. a PCB—see FIG. 5) within the body 16.

In a currently preferred embodiment, the driver 24 is a voltage-to-current converter. In a particularly preferred embodiment, the driver 24 includes the possibility of control single color, multi-color or dimmable operation. The driver board 24*a* hosts various components (of a known type) to control the drive currents of the LED sources 10.

The shape of the body 16 is designed to keep the driver board 24*a* at a given position by locking the board 24*a* to that position. The driver board 24*a* may thus be exchangeable. The connections between the circuit board 24*a* and the LED light sources 10 may include a flexible portion of the driver board or a flexible cable or ribbon-like flat wiring 26, extending from the board 24*a* to the PCB element 18*a* through an opening 28 in the body 16 (see FIG. 5).

Wiring 30 may be arranged within the body 16 to allow a feed-through (i.e. cascaded) connection to one or more homologous structures. For that purpose, the driver PCB 24*a* may have associated connectors 32, 34 arranged at the ends of the body 16 (see e.g. FIG. 3) and adapted to permit series connection of two or more lighting structures of the kind described in the foregoing. Essentially the connector 32 and 34 are adapted to permit plug-and-socket connection by inserting the (e.g. male-type) connector 34 of one structure into a complementary (e.g. female-type) connector 32 carried by another neighboring structure.

Figure 5:
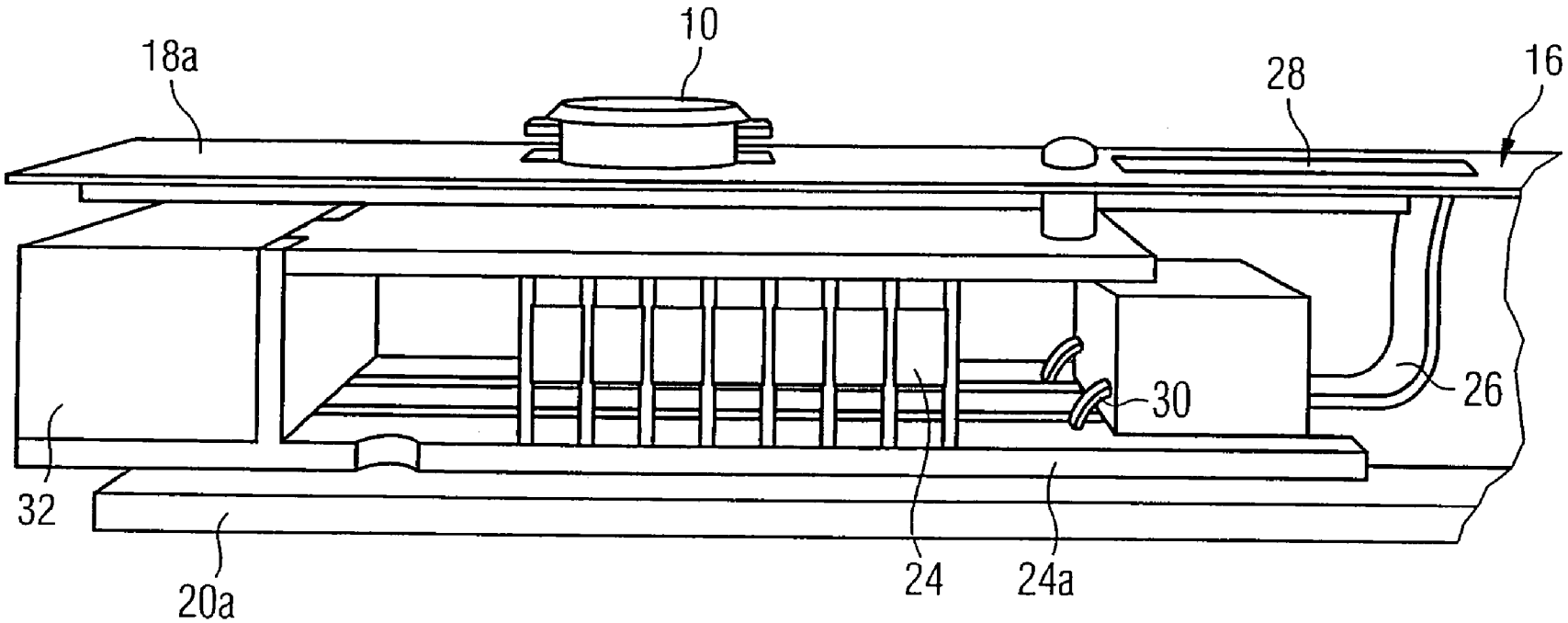
FIG. 5 is a partly broken perspective side view of a portion of the structure of FIG. 1 showing in greater detail a possible arrangement of components therein.

Even in the absence of such a plug-and-socket structure, a single connector 32 as shown in FIG. 5 is adapted to permit easy connection of the driver board 24*a* to a power source to supply electrical power to the LED sources 10.

Figure 3:
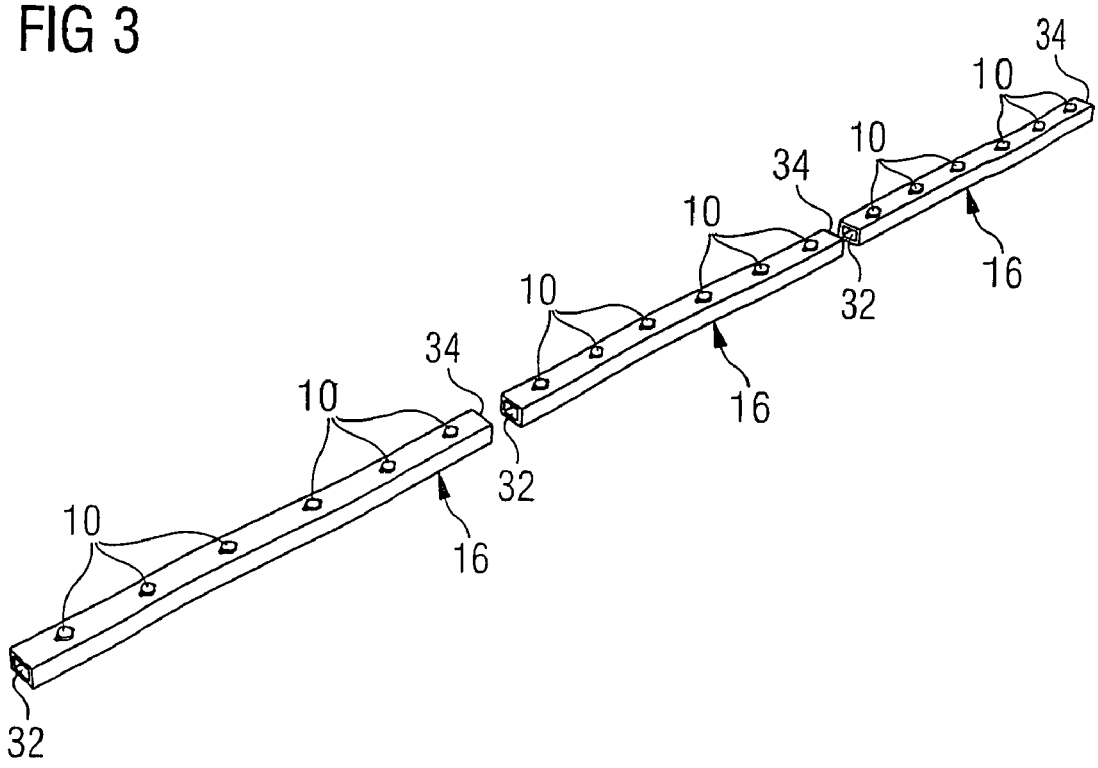
FIG. 3 shows the possible series mounting of a number of structures as shown in FIG. 1.
Figure 4:
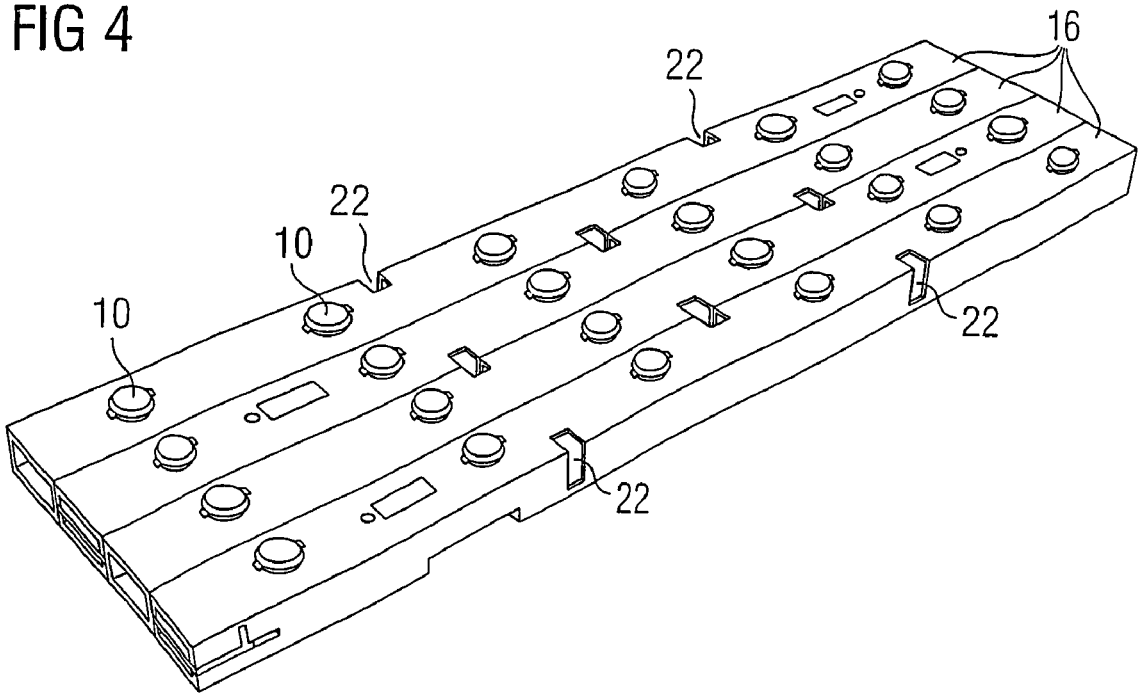
FIG. 4 shows a number of structures as shown in FIG. 1 assembled side-by side.

As an alternative to the series connection illustrated in FIG. 3, the possibility exists of chaining up two or more identical structures in a side-by-side structure as illustrated in FIG. 4. Gaps can be possibly created between neighboring structures; alternatively, two ore more structures can be grouped to form a no gap, compact structure, as shown in FIG. 5.

In either case (linear, series connection of FIG. 3; parallel, side-by-side structure of FIG. 4) a constant LED pitch can be easily ensured, without having to resort to additional tools such as e.g. mounting jigs or the like.

Consequently, without prejudice to the underlying principles of the invention, the details and the embodiments may vary, even appreciably, with reference to what has been described by way of example only, without departing from the scope of the invention as defined by the annexed claims.

The invention claimed is:

1. An LED lighting system comprising at least two homologous mounting structures, each of the homologous mounting structures comprising: at least one LED lighting source; a support body comprising a hollow body having a free space inside; a circuit board for mounting said at least one LED lighting source, said circuit board having conductive traces to feed electrical power to said at least one LED lighting source, wherein the circuit board is attached to a top of the support body; connectors to allow cascaded connection to other homologous mounting structures, said connectors comprising: a first connector receiving power from a power source or from a connector of a first one of the homologous mounting structures, a second connector providing the received power to a connector of a second one of the homologous mounting structures, wherein the first and second connectors are electrically connected such that a voltage of the power received at the first connector is substantially the same as a voltage of the power provided at the second connector, and wherein the first and second connectors are complementary with respect to one another; and a driver circuit for driving the at least one LED lighting source, wherein: the driver circuit provides electrical power received at the first connector to the at least one LED lighting source via the conductive traces of the circuit board, the driver circuit controls a drive current provided to the at least one LED lighting source, and the driver circuit is mounted within the free space of the support body, and the driver circuit provides power to and controls the current of only the at least one LED lighting source mounted on the circuit board of the mounting structure, wherein the at least one LED lighting source of each of the mounting structures is independently driven with respect to the LED lighting source of another mounting structure.

2. The structure of claim 1, wherein said circuit board is a printed-circuit board.

3. The structure of claim 2, wherein said circuit board has said conductive traces printed thereon.

4. The structure of claim 1, wherein said at least one LED lighting source includes an assembly having protruding contacts for contacting said conductive traces.

5. The structure of claim 1, wherein said support body is in the form of an elongated bar.

6. The structure of claim 1, wherein said support body is in the form of a box with a shape selected out of linear, round, square, hexagonal, octagonal.

7. The structure of claim 1, wherein said support body is a drawn or molded body.

8. The structure of claim 1, wherein said support body is of a lightweight material.

9. The structure of claim 1, wherein said support body is aluminum.

10. The structure of claim 1, wherein said support body is of a plastics material.

11. The structure of claim 1, wherein said support body is of a material having a good heat transfer coefficient.

12. The structure of claim 1, wherein said support body includes passages for mounting retain elements.

13. The structure of claim 1, wherein said support body includes a back side for mounting the structure on a supporting surface.

14. The structure of claim 1, wherein said support body has coupled a heat dissipation fixture.

15. The structure of claim 1, wherein said support body is at least partially apertured to permit cooling air flow therethrough.

16. The structure of claim 1, wherein electrical connection between said driver circuit and said at least one LED lighting source includes one of a flexible portion of a driver board, a flexible cable or flexible ribbon-like flat wiring.

17. The structure of claim 16, wherein said flexible electrical connection extends through an opening in said support body.

18. The structure of claim 1, wherein it includes said connectors arranged at opposite ends of said support body to permit plug-and-socket connection of one connector carried by the structure with at least another, complementary connector carried by a neighboring structure.

19. The structure of claim 1, wherein said support body is configured for linear series connection of a plurality of homologous structures.

20. The structure of claim 1, wherein said support body is configured for parallel, side-by-side connection of a plurality of homologous structures.

21. The structure of claim 1, wherein said support body is configured for constant pitch mounting a plurality of said LED lighting sources.

22. An LED lighting system comprising at least two mounting structures, each of the mounting structures comprising: at least one LED lighting source; a support body comprising a hollow body having a free space inside, wherein said support body is at least partially apertured to permit cooling air flow therethrough and said support body is aluminum; a circuit board for mounting said at least one LED lighting source, said circuit board having conductive traces to feed electrical power to said at least one LED lighting source, wherein the circuit board is attached to a top of the support body; connectors to allow cascaded connection to other homologous mounting structures, said connectors comprising: a first connector receiving power from a power source or from a connector of a first one of the homologous mounting structures, a second connector providing the received power to a connector of a second one of the homologous mounting structures, wherein the first and second connectors are electrically connected such that a voltage of the power received at the first connector is substantially the same as a voltage of the power provided at the second connector, and wherein the first and second connectors are complementary with respect to one another; and a driver circuit for driving the at least one LED lighting source, wherein the driver circuit provides electrical power received at the first connector to the at least one LED lighting source via the conductive traces of the circuit board, the driver circuit controls a drive current provided to the at least one LED lighting source, and the driver circuit is mounted within the free space of the support body, and the driver circuit provides power to and controls the current of only the at least one LED lighting source mounted on the circuit board of the mounting structure, wherein the at least one LED lighting source of each of the mounting structures is independently driven with respect to the LED lighting source of another mounting structure.

23. An LED lighting system comprising at least two mounting structures, each of the mounting structures comprising: at least one LED lighting source; a support body comprising an elongated hollow body having a free space inside, said support body having ends, a top, a bottom, and sides, wherein said support body is configured for parallel, side-by-side connection of a plurality of homologous structures; a circuit board for mounting said at least one LED lighting source, said circuit board having conductive traces to feed electrical power to said at least one LED lighting source, wherein the circuit board is attached to a top of the support body; connectors to allow cascaded connection to other homologous mounting structures, said connectors comprising: a first connector receiving power from a power source or from a connector of a first one of the homologous mounting structures, a second connector providing the received power to a connector of a second one of the homologous mounting structures, wherein the first and second connectors are electrically connected such that a voltage of the power received at the first connector is substantially the same as a voltage of the power provided at the second connector, and wherein the first and second connectors are complementary with respect to one another; and a driver circuit for driving the at least one LED lighting source, wherein: the driver circuit provides electrical power received at the first connector to the at least one LED lighting source via the conductive traces of the circuit board, the driver circuit controls a drive current provided to the at least one LED lighting source, and the driver circuit is mounted within the free space of the support body, and the driver circuit provides power to and controls the current of only the at least one LED lighting source mounted on the circuit board of the mounting structure, wherein the at least one LED lighting source of each of the mounting structures is independently driven with respect to the LED lighting source of another mounting structure.

* * * * *